US008044872B2

(12) United States Patent
Stroes et al.

(10) Patent No.: US 8,044,872 B2
(45) **Date of Patent: *Oct. 25, 2011**

(54) ODU ALIGNMENT PROCEDURE USING CIRCULARLY POLARIZED SIGNALS ALLOCATED TO SPECIFIC SATELLITES

(75) Inventors: Gustave R. Stroes, Beverly Hills, CA (US); Benjamin Mui, Redondo Beach, CA (US)

(73) Assignee: The DIRECTV Group, Inc., El Segundo, CA (US)

( * ) Notice: Subject to any disclaimer, the term of this patent is extended or adjusted under 35 U.S.C. 154(b) by 845 days.

This patent is subject to a terminal disclaimer.

(21) Appl. No.: 11/971,808

(22) Filed: Jan. 9, 2008

(65) Prior Publication Data

US 2008/0165070 A1 Jul. 10, 2008

Related U.S. Application Data

(60) Provisional application No. 60/879,376, filed on Jan. 9, 2007.

(51) Int. Cl.
*H01Q 3/00* (2006.01)

(52) U.S. Cl. ..... 343/757

(58) Field of Classification Search ..... 343/757, 343/756; 455/12.1, 427
See application file for complete search history.

(56) References Cited

U.S. PATENT DOCUMENTS

| | | | | |
|---|---|---|---|---|
| 6,580,391 | B1 * | 6/2003 | Kepley et al. | 342/359 |
| 7,437,123 | B2 * | 10/2008 | Karabinis et al. | 455/12.1 |
| 7,791,552 | B1 * | 9/2010 | Romanofsky | 343/754 |
| 2003/0090412 | A1 * | 5/2003 | Rao et al. | 342/354 |
| 2007/0072545 | A1 * | 3/2007 | Karabinis et al. | 455/12.1 |

OTHER PUBLICATIONS

Installation manual DirectTV multi satellite dish antenna with integrated triple LNB and built in multi switch.*
Non-final Office action dated Sep. 16, 2010 in U.S. Appl. No. 11/971,800, filed Jan. 9, 2008 by Gustave R. Stroes et al.
Notice of Allowance dated Mar. 3, 2011 in U.S. Appl. No. 11/971,800, filed Jan. 9, 2008 by Gustave R. Stroes et al.

* cited by examiner

*Primary Examiner* — Huedung Mancuso

(57) ABSTRACT

A method and system for aligning an antenna reflector with satellites in a satellite configuration. A method in accordance with the present invention comprises pointing the reflector to an orbital slot used in the satellite configuration, wherein only one satellite in the orbital slot transmits first circularly polarized signals, and adjusting the reflector to maximize reception of the first circularly polarized signals from the orbital slot. A system in accordance with the present invention comprises a reflector, a power meter coupled to the reflector, wherein the power meter and reflector are tuned to receive first circularly polarized signals, and an alignment mechanism, coupled to the reflector, wherein the alignment mechanism is manipulated to point the reflector at an orbital slot wherein only one satellite in the orbital slot transmits the first circularly polarized signals, and to adjust the reflector to maximize reception of the first circularly polarized signals from the orbital slot.

11 Claims, 4 Drawing Sheets

ODU ALIGNMENT PROCEDURE USING CIRCULARLY POLARIZED SIGNALS ALLOCATED TO SPECIFIC SATELLITES

CROSS-REFERENCE TO RELATED APPLICATIONS

This application claims the benefit under 35 U.S.C. §119 (e) of U.S. Provisional Application Ser. No. 60/879,376, fled Jan. 9, 2007, by Gustave R. Stroes et al, entitled "ODU ALIGNMENT PROCEDURE USING CIRCULARLY POLARIZED SIGNALS ALLOCATED TO SPECIFIC SATELLITES," which application is incorporated by reference herein.

This application is related to the following application:

Application Ser. No. 60/879,394, filed on Jan. 9, 2007, by Gustave R. Stroes and Benjamin Mui, entitled "ODU ALIGNMENT PROCEDURE USING CIRCULARLY POLARIZED SQUINT,"

which application is incorporated by reference herein.

BACKGROUND OF THE INVENTION

1. Field of the Invention

The present invention relates generally to a satellite receiver system, and in particular, to an alignment method for multi-band consumer receiver antennas.

2. Description of the Related Art

Satellite broadcasting of communications signals has become commonplace. Satellite distribution of commercial signals for use in television programming currently utilizes multiple feedhorns on a single Outdoor Unit (ODU) which supply signals to up to eight IRDs on separate cables from a multiswitch.

FIG. 1 illustrates a typical satellite television installation of the related art.

System 100 uses signals sent from Satellite A (SatA) 102, Satellite B (SatB) 104, and Satellite C (SatC) 106 (with transponders 28, 30, and 32 converted to transponders 8, 10, and 12, respectively), that are directly broadcast to an Outdoor Unit (ODU) 108 that is typically attached to the outside of a house 110. ODU 108 receives these signals and sends the received signals to IRD 112, which decodes the signals and separates the signals into viewer channels, which are then passed to television 114 for viewing by a user. There can be more than one satellite transmitting from each orbital location. Orbital locations are also known as "orbital slots" and are referred to as both "orbital locations" and "orbital slots" herein.

Satellite uplink signals 116 are transmitted by one or more uplink facilities 118 to the satellites 102-106 that are typically in geosynchronous orbit. Satellites 102-106 amplify and rebroadcast the uplink signals 116, through transponders located on the satellite, as downlink signals 120. Depending on the satellite 102-106 antenna pattern, the downlink signals 120 are directed towards geographic areas for reception by the ODU 108.

Each satellite 102-106 broadcasts downlink signals 120 in typically thirty-two (32) different sets of frequencies, often referred to as transponders, which are licensed to various users for broadcasting of programming, which can be audio, video, or data signals, or any combination. These signals have typically been located in the Ku-band Fixed Satellite Service (FSS) and Broadcast Satellite Service (BSS) bands of frequencies in the 10-13 GHz range. Future satellites will likely also broadcast in a portion of the Ka-band with frequencies of 18-21 GHz FIG. 2 illustrates a typical ODU of the related art.

ODU 108 typically uses reflector dish 122 and feedhorn assembly 124 to receive and direct downlink signals 120 onto feedhorn assembly 124. Reflector dish 122 and feedhorn assembly 124 are typically mounted on bracket 126 and attached to a structure for stable mounting. Feedhorn assembly 124 typically comprises one or more Low Noise Block converters 128, which are connected via wires or coaxial cables to a multiswitch, which can be located within feedhorn assembly 124, elsewhere on the ODU 108, or within house 110. LNBs typically downconvert the FSS and/or BSS-band, Ku-band, and Ka-band downlink signals 120 into frequencies that are easily transmitted by wire or cable, which are typically in the L-band of frequencies, which typically ranges from 250 MHz to 2150 MHz. This downconversion makes it possible to distribute the signals within a home using standard coaxial cables.

The multiswitch enables system 100 to selectively switch the signals from SatA 102, SatB 104, and SatC 106, and deliver these signals via cables 124 to each of the IRDs 112A-D located within house 110. Typically, the multiswitch is a five-input, four-output (5×4) multiswitch, where two inputs to the multiswitch are from SatA 102, one input to the multiswitch is from SatB 104, and one input to the multiswitch is a combined input from SatB 104 and SatC 106. There can be other inputs for other purposes, e.g., off-air or other antenna inputs, without departing from the scope of the present invention. The multiswitch can be other sizes, such as a 6×8 multiswitch, if desired. SatB 104 typically delivers local programming to specified geographic areas, but can also deliver other programming as desired.

To maximize the available bandwidth in the Ku-band of downlink signals 120, each broadcast frequency is further divided into polarizations. Each LNB 128 can receive both orthogonal polarizations at the same time with parallel sets of electronics, so with the use of either an integrated or external multiswitch, downlink signals 120 can be selectively filtered out from travelling through the system 100 to each IRD 112A-D.

IRDs 112A-D currently use a one-way communications system to control the multiswitch. Each IRD 112A-D has a dedicated cable 124 connected directly to the multiswitch, and each IRD independently places a voltage and signal combination on the dedicated cable to program the multiswitch. For example, IRD 112A may wish to view a signal that is provided by SatA 102. To receive that signal, IRD 112A sends a voltage/tone signal on the dedicated cable back to the multiswitch, and the multiswitch delivers the satA 102 signal to IRD 112A on dedicated cable 124. IRD 112B independently controls the output port that IRD 112B is coupled to, and thus may deliver a different voltage/tone signal to the multiswitch. The voltage/tone signal typically comprises a 13 Volts DC (VDC) or 18 VDC signal, with or without a 22 kHz tone superimposed on the DC signal. 13VDC without the 22 kHz tone would select one port, 13VDC with the 22 kHz tone would select another port of the multiswitch, etc. There can also be a modulated tone, typically a 22 kHz tone, where the modulation schema can select one of any number of inputs based on the modulation scheme. For simplicity and cost savings, this control system has been used with the constraint of 4 cables coming for a single feedhorn assembly 124, which therefore only requires the 4 possible state combinations of tone/no-tone and hi/low voltage.

To reduce the cost of the ODU 108, outputs of the LNBs 128 present in the ODU 108 can be combined, or "stacked," depending on the ODU 108 design. The stacking of the LNB 128 outputs occurs after the LNB has received and downconverted the input signal. This allows for multiple polarizations, one from each satellite 102-106, to pass through each LNB 128. So one LNB 128 can, for example, receive the Left Hand Circular Polarization (LHCP) signals from SatC 102 and SatB 104, while another LNB receives the Right Hand Circular Polarization (RHCP) signals from SatB 104, which allows for fewer wires or cables between the feedhorn assembly 124 and the multiswitch.

The Ka-band of downlink signals 120 will be further divided into two bands, an upper band of frequencies called the "A" band and a lower band of frequencies called the "B" band. Once satellites are deployed within system 100 to broadcast these frequencies, the various LNBs 128 in the feedhorn assembly 124 can deliver the signals from the Ku-band, the A band Ka-band, and the B band Ka-band signals for a given polarization to the multiswitch. However, current IRD 112 and system 100 designs cannot tune across this entire resulting frequency band without the use of more than 4 cables, which limits the usefulness of this frequency combining feature.

By stacking the LNB 128 inputs as described above, each LNB 128 typically delivers 48 transponders of information to the multiswitch, but some LNBs 128 can deliver more or less in blocks of various size. The multiswitch allows each output of the multiswitch to receive every LNB 128 signal (which is an input to the multiswitch) without filtering or modifying that information, which allows for each IRD 112 to receive more data. However, as mentioned above, current IRDs 112 cannot use the information in some of the proposed frequencies used for downlink signals 120, thus rendering useless the information transmitted in those downlink signals 120. Typically, an antenna reflector 122 is pointed toward the southern sky, and roughly aligned with the satellite downlink 120 beam, and then fine-tuned using a power meter or other alignment tools. The precision of such an alignment is usually not critical. However, additional satellites are being deployed that require more exacting alignment methods, and, without exacting alignment of the antenna reflector 122, the signals from the additional satellites will not be properly received, rendering these signals useless for data and video transmission.

It can be seen, then, that there is a need in the art for an alignment method for a satellite broadcast system that can be expanded to include new satellites and new transmission frequencies.

SUMMARY OF THE INVENTION

To minimize the limitations in the prior art, and to minimize other limitations that will become apparent upon reading and understanding the present specification, the present invention discloses a method for aligning a multi-satellite receiver antenna, and more specifically, a method, apparatus and system for aligning an antenna reflector using a circularly polarized signal.

A method in accordance with the present invention comprises pointing the reflector to an orbital slot used in the satellite configuration, wherein only one satellite in the orbital slot transmits first circularly polarized signals, and adjusting the reflector to maximize reception of the first circularly polarized signals from the orbital slot.

Such a method further optionally includes at least one other satellite in the orbital slot transmitting second circularly polarized signals, offsetting the reflector from a position where maximum reception of the first circularly polarized signals is measured, and the satellite in the orbital slot transmitting in a Ka-band of frequencies.

A system in accordance with the present invention comprises a reflector, a power meter coupled to the reflector, wherein the power meter and reflector are tuned to receive first circularly polarized signals, and an alignment mechanism, coupled to the reflector, wherein the alignment mechanism is manipulated to point the reflector at an orbital slot wherein only one satellite in the orbital slot transmits the first circularly polarized signals, and to adjust the reflector to maximize reception of the first circularly polarized signals from the orbital slot.

Such a system further optionally includes at least one other satellite in the orbital slot transmitting second circularly polarized signals, offsetting the reflector from a position where maximum reception of the first circularly polarized signals is measured, and the satellite in the orbital slot transmitting in a Ka-band of frequencies.

Another system in accordance with the present invention receives satellite signals being transmitted from a plurality of orbital slots, and comprises a reflector and an alignment mechanism, coupled to the reflector, wherein the alignment mechanism is manipulated to point the reflector at an alignment point in a selected orbital slot in the plurality of orbital slots, wherein only one satellite in the selected orbital slot transmits the first circularly polarized signals.

Such a system further optionally comprises at least one other satellite in the selected orbital slot transmits second circularly polarized signals, offsetting the reflector from the alignment point, the satellite in the orbital slot transmits in a Ka-band of frequencies, the alignment point being determined by a signal strength of the first circularly polarized signals, and the reflector being offset from the alignment point based on a total number of satellites located at the selected orbital slot.

Other features and advantages are inherent in the system and method claimed and disclosed or will become apparent to those skilled in the art from the following detailed description and its accompanying drawings.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

Figure 1:
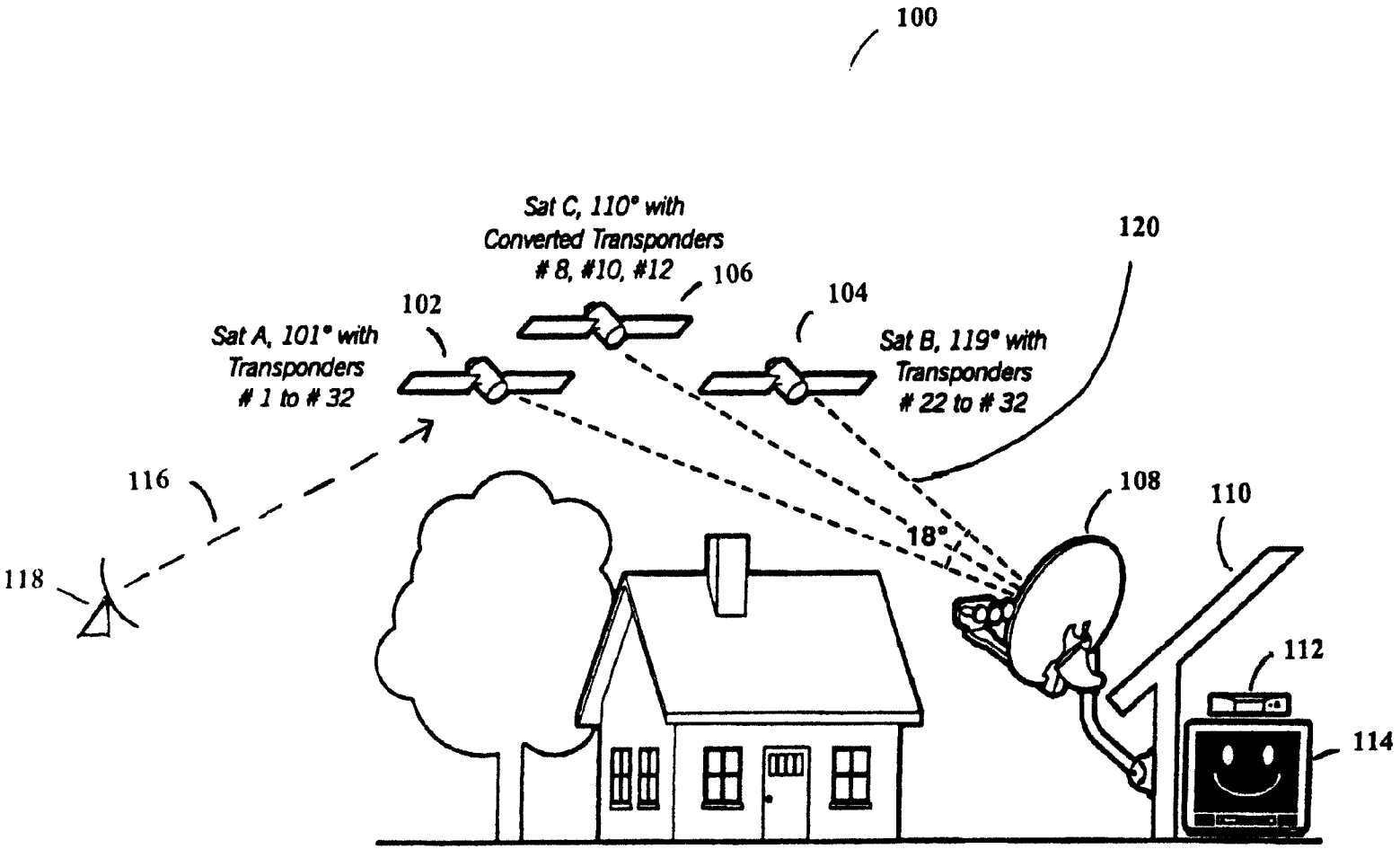
FIG. 1 illustrates a typical satellite television installation of the related art.
Figure 2:
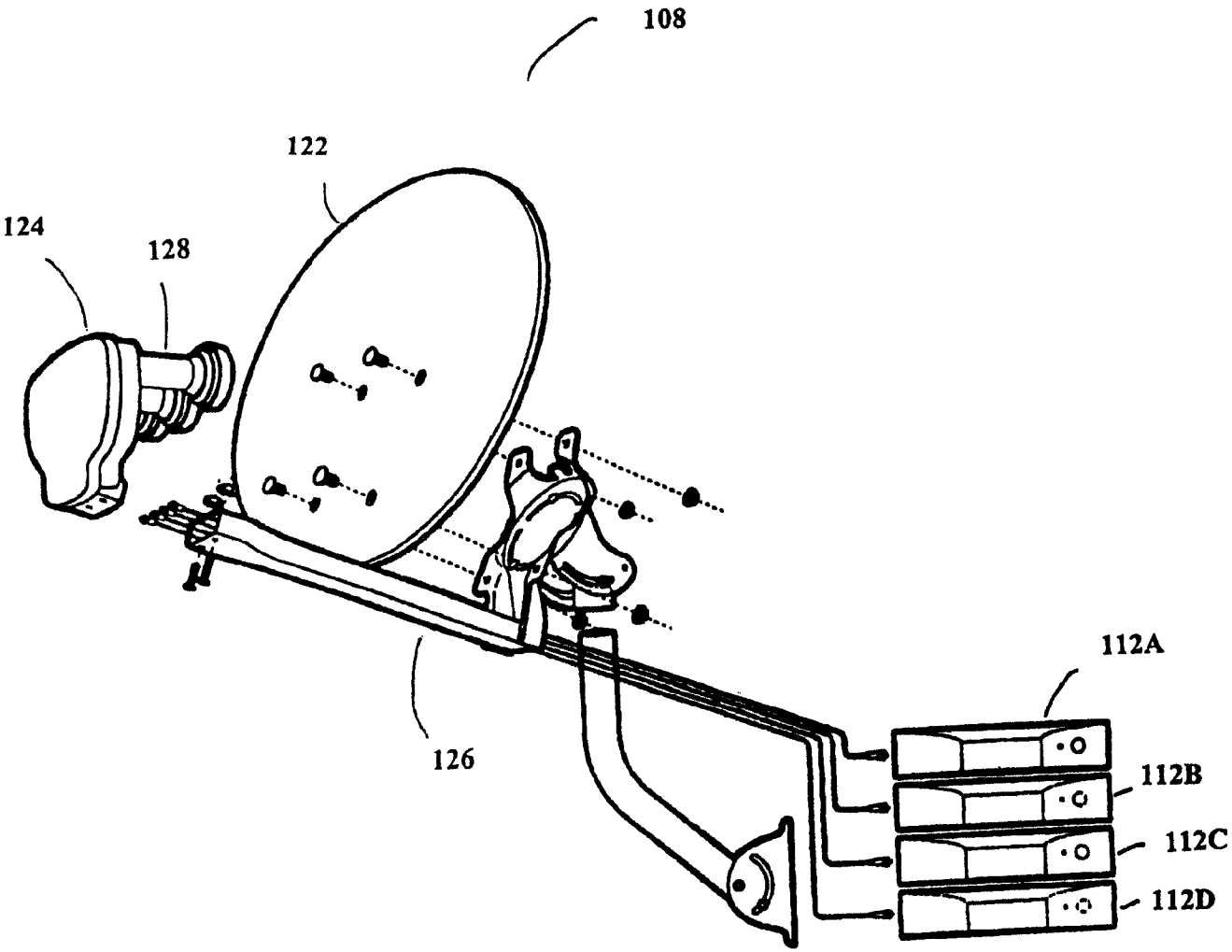
FIG. 2 illustrates a typical ODU of the related art.

In the following description, reference is made to the accompanying drawings which form a part hereof, and which show, by way of illustration, several embodiments of the present invention. It is understood that other embodiments may be utilized and structural changes may be made without departing from the scope of the present invention.

Overview

System 100 uses signals sent from Satellite A (SatA) 102, Satellite B (SatB) 104, and Satellite C (SatC) 106 that are directly broadcast to an Outdoor Unit (ODU) 108 that is typically attached to the outside of a house 110. Additionally, system 100 uses signals sent from satellites 103, which can be broadcast at a different frequency band than the signals sent by satellites 102-106 for use in system 100.

Satellites 102, 104, and 106 broadcasts downlink signals 120 in typically thirty-two (32) different frequencies, which are licensed to various users for broadcasting of programming, which can be audio, video, or data signals, or any combination. These signals are typically located in the Ku-band of frequencies, i.e., 11-18 GHz. Other satellites typically broadcast in the Ka-band of frequencies, i.e., 18-40 GHz, but typically 20-30 GHz. Satellites 102-106 can broadcast in multiple frequency bands if desired.

The orbital locations of satellites 102-106 are fixed by regulation, so, for example, there are one or more satellites at 101 degrees West Longitude (WL), represented by SatA 102; other satellites at 110 degrees WL, represented by SatC 106; and still other satellites at 119 degrees WL, represented by SatB 104. Other groups of satellites are located at other orbital slots, such as 102.8 degrees WL, and still other satellites are located at the orbital slot at 99.2 degrees WL. Other satellites may be at other orbital slots, e.g., 72.5 degrees, 95 degrees, and other orbital slots, without departing from the scope of the present invention. The satellites are typically referred to by their orbital location, e.g., SatA 102, the satellite at 101 WL, is typically referred to as "101."

Dish Alignment

Current requirements for consumer receiver dish (ODU 108) alignment are less stringent than with a larger fleet of satellites. The more rigorous alignment specs are in large part due to the relatively new art of broadcasting Direct-To-Home (DTH) signals in the Ka-band of frequencies.

Ka-band transmit beams are more narrow than the traditional Ku-band beams. As such, the ODU 108 must be pointed to the transmitting satellite(s) more accurately. If the ODU 108 alignment is not accurate enough, a sharp roll-off in signal strength will result, which may not allow IRD 112 to properly decode the transmitted signals.

Another fact that necessitates accurate alignment of the ODU 108 in the Ka-frequency band is that Ka-band satellites are separated by only 2 degrees along the orbital arc, as opposed to the relatively large satellite spacing of 9 degrees used for the satellites transmitting in the Ku-band of frequencies. If the ODU 108 is not accurately pointed to the Ka-band source, then it can be subject to adjacent satellite interference from neighboring Ka-band satellites.

The present invention uses a satellite placed at a particular location in orbit, and that satellites' position relative to the center of the orbital slot, in order to make possible very accurate pointing of a consumer receive antenna (ODU).

Description of Orbital Slot Alignment

Figure 3:
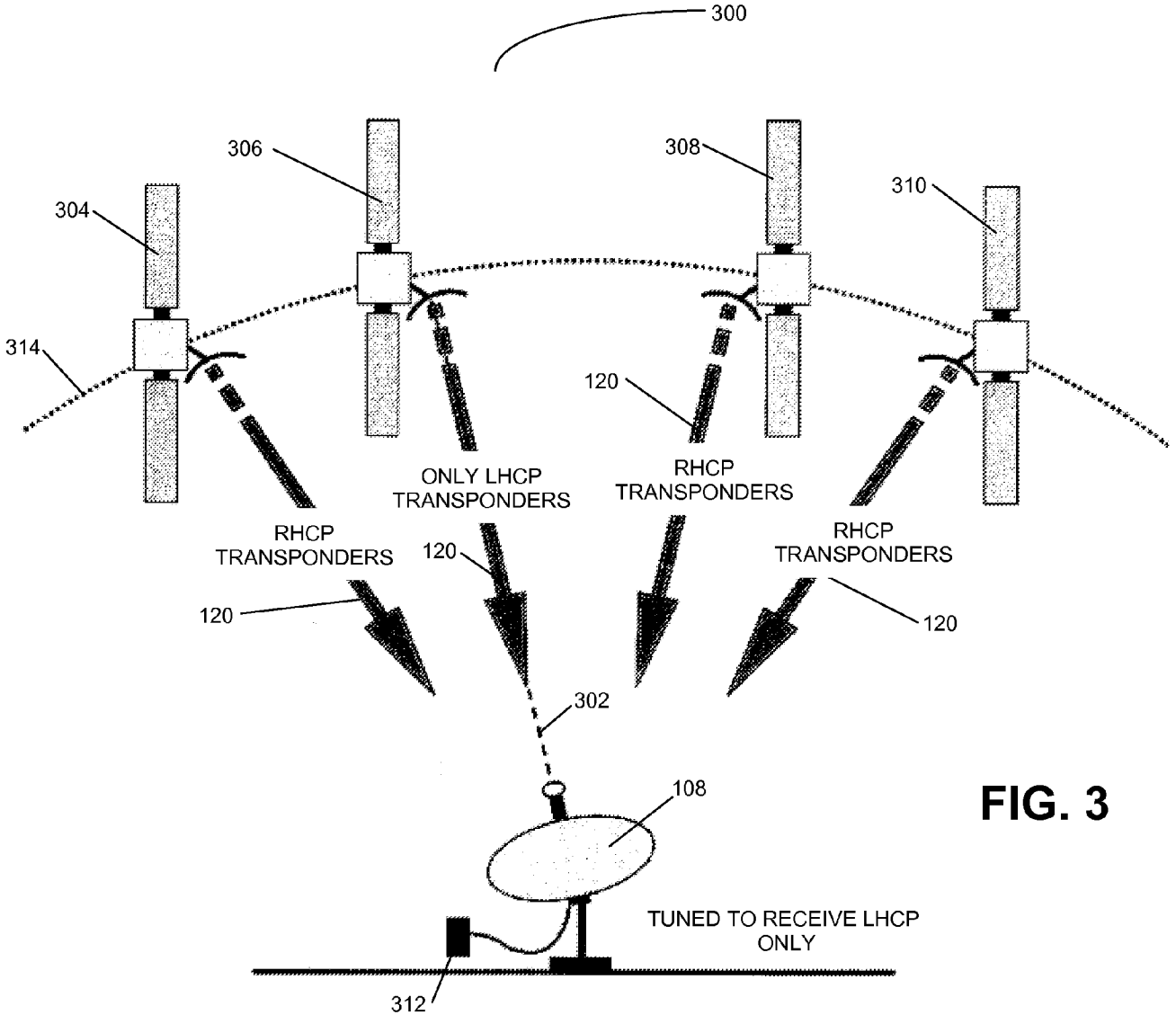
FIG. 3 illustrates a typical orbital slot as used in conjunction with the present invention.

FIG. 3 illustrates a typical orbital slot as used in conjunction with the present invention.

Orbital slot 300 is shown, comprising satellites 304-310. Orbital slot 300 can be any orbital slot, e.g., 99, 101, 75, 119, 103, etc., without departing from the scope of the present invention.

As shown in FIG. 3, the ODU 108, to be properly aligned to all of the satellites 304-310 in the orbital slot 300, should point to the alignment point 302 of the orbital slot 300. However, if a given orbital slot 300 has two satellites, say 304 and 306, on one side of the alignment point 302, and only one satellite 308 on the other side of the alignment point 302, another alignment point 302 can be chosen for ODU 108. Such an alignment point 302 can be chosen through the use of offsets from a maximum signal strength, design of the ODU 108, or other methods.

Typically, the ODU 108 is aligned using a power meter 312 that measures a broad power spectrum which is received from all of satellites 304-310. As such, ODU is aligned to a point that is an average power peak across all satellites 304-310 at orbital slot 300, but this point may not necessarily the best alignment location.

A typical alignment of the ODU 108 involves using signal strength meter 312 to measure signal strength downstream of the filters which are part of the LNB 128 portion of the receive antenna (ODU 108). Thus the meter 312 will generally only measure the signal strength of those frequencies that are intended to be received by the receive system. If the signal strength meter 312 is of the "broadband power" type, then it will pick up signals from any satellite 304-310 at a particular orbit slot that is transmitting in the broadcast company's frequency band. These satellites 304-310 are often spread apart in the orbit arc 314 by several tenths of a degree. This makes it difficult to point the ODU 108 exactly to a specific spot. The ODU 108 typically ends up pointed to the location of highest average signal strength, but this might not coincide with the location of any of the satellites 304-310, and it might not be the alignment point 302 of the orbital slot 300.

The present invention allows a consumer receive antenna (ODU 108) to be pointed to an exact location, namely, the alignment point 302, of an orbital slot 300. A Direct to Home (DTH) satellite broadcast company might own as many as 32 frequencies in the Ku-band at a particular orbital slot 300. These frequencies might be shared across multiple satellites 304-310 that the broadcasting company has located at this one particular orbital slot 300, each satellite in a slightly different location within the orbital slot 300. For each orbital slot 300, an alignment point 302 can be determined using the present invention.

The present invention uses the polarization of the transmitted signals being sent from satellites 304-310 to align ODU 108. So, for example, satellites 304, 308, and 310 can be designed to send signals 120 that are Right-Hand Circularly Polarized (RHCP) while satellite 306 can be designed to transmit only Left-Hand Circularly Polarized (LHCP) signals 120. When alignment of ODU 108 is undertaken, the ODU 108 can be "tuned" to receive only LHCP signals, e.g., the signals from satellite 306. When the power meter 312 is maximized for LHCP signals, alignment point 302 will point directly at satellite 306, plus or minus 0.05 degrees, and any offsets desired from alignment point 302 can be made based on geography, etc. from alignment point 302.

In other words, if satellite 306 transmits a circularly polarized signal, either entirely left-hand polarized, or entirely right-hand polarized, and the satellite 306 is also placed at a specific orbital location 300, then the ODU 108 can be pointed exactly to satellite 306, rather than to a generic power "center" of the orbital slot 300. The location of the "boresighted" satellite 306 is determined using the power from a first polarization from one of the satellites at the orbital slot 300, and a second polarization from other satellites at that orbital slot 300.

This pointing scheme is extremely useful in that it aligns the feed cluster 128 so that the ODU 108 can receive optimum signal strength, or at least acceptable signal strength, from other satellites, e.g. satellites 304, 308, and 310, located at the orbital slot 300, as well as from other satellites located at different orbital slots 300.

The invention described herein requires that the satellite fleet be configured in a specific manner, such that one particular satellite at the orbital slot 300 of interest transmits all of the available transponders of one polarity (either Left Hand circularly polarized or Right Hand circularly polarized). The transponders of the opposite polarity can be distributed among the remaining satellites at the orbit slot. For example, and not by way of limitation, as shown in FIG. 3, satellite 306 transmits all of the LHCP signals, while the RHCP signals are all transmitted by the other satellites 304, 308, and 310 at orbital slot 300.

With this distribution of transponders accomplished, setting the ODU to the appropriate polarity (via input voltage and tone) will ensure that the wideband signal strength meter detects only signals from the one particular satellite in question (the satellite which transmits all available transponders of only one polarity), and align to that satellite rather than to a generic spot along the orbital arc 314.

Process Chart

Figure 4:
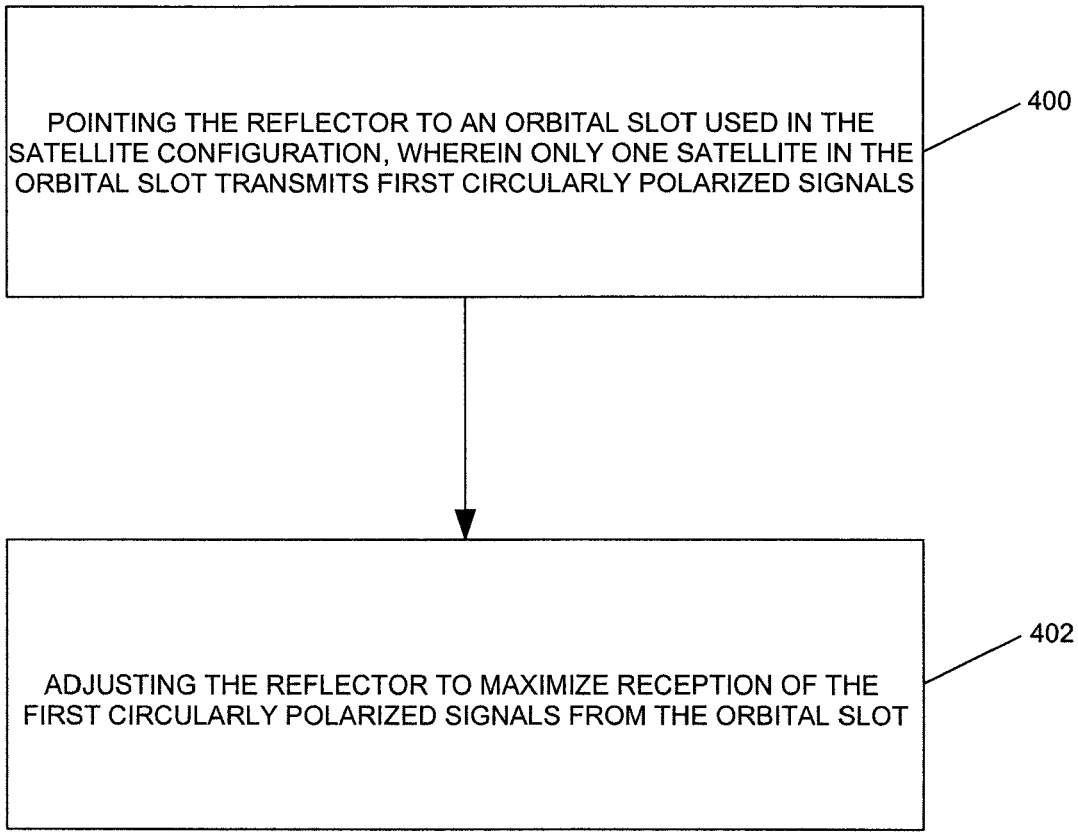
FIG. 4 illustrates a process chart in accordance with the present invention.

FIG. 4 illustrates a process chart in accordance with the present invention.

Box 400 illustrates pointing the reflector to an orbital slot used in the satellite configuration, wherein only one satellite in the orbital slot transmits first circularly polarized signals.

Box 402 illustrates adjusting the reflector to maximize reception of the first circularly polarized signals from the orbital slot.

Conclusion

In summary, the present invention comprises a method and system for aligning an antenna reflector with satellites in a satellite configuration. A method in accordance with the present invention comprises pointing the reflector to an orbital slot used in the satellite configuration, wherein only one satellite in the orbital slot transmits first circularly polarized signals, and adjusting the reflector to maximize reception of the first circularly polarized signals from the orbital slot.

Such a method further optionally includes at least one other satellite in the orbital slot transmitting second circularly polarized signals, offsetting the reflector from a position where maximum reception of the first circularly polarized signals is measured, and the satellite in the orbital slot transmitting in a Ka-band of frequencies.

A system in accordance with the present invention comprises a reflector, a power meter coupled to the reflector, wherein the power meter and reflector are tuned to receive first circularly polarized signals, and an alignment mechanism, coupled to the reflector, wherein the alignment mechanism is manipulated to point the reflector at an orbital slot wherein only one satellite in the orbital slot transmits the first circularly polarized signals, and to adjust the reflector to maximize reception of the first circularly polarized signals from the orbital slot.

Such a system further optionally includes at least one other satellite in the orbital slot transmitting second circularly polarized signals, offsetting the reflector from a position where maximum reception of the first circularly polarized signals is measured, and the satellite in the orbital slot transmitting in a Ka-band of frequencies.

Another system in accordance with the present invention receives satellite signals being transmitted from a plurality of orbital slots, and comprises a reflector and an alignment mechanism, coupled to the reflector, wherein the alignment mechanism is manipulated to point the reflector at an alignment point in a selected orbital slot in the plurality of orbital slots, wherein only one satellite in the selected orbital slot transmits the first circularly polarized signals.

Such a system further optionally comprises at least one other satellite in the selected orbital slot transmits second circularly polarized signals, offsetting the reflector from the alignment point, the satellite in the orbital slot transmits in a Ka-band of frequencies, the alignment point being determined by a signal strength of the first circularly polarized signals, and the reflector being offset from the alignment point based on a total number of satellites located at the selected orbital slot.

It is intended that the scope of the invention be limited not by this detailed description, but rather by the claims appended hereto and the equivalents thereof. The above specification, examples and data provide a complete description of the manufacture and use of the composition of the invention. Since many embodiments of the invention can be made without departing from the spirit and scope of the invention, the invention resides in the claims hereinafter appended and the equivalents thereof.

What is claimed is:

1. A method for aligning a reflector of an antenna with a satellite configuration, comprising:

pointing the reflector to an orbital slot having a plurality of satellites used in the satellite configuration, wherein only one satellite of the plurality of satellites in the orbital slot transmits first circularly polarized signals;

adjusting the reflector to maximize reception of the first circularly polarized signals from the orbital slot; and offsetting the reflector from a position where maximum reception of the first circularly polarized signals is measured.

2. The method of claim 1, wherein at least one other satellite in the orbital slot transmits second circularly polarized signals.

3. The method of claim 1, wherein the satellite in the orbital slot transmits in a Ka-band of frequencies.

4. A system for aligning a reflector of an antenna with a satellite configuration, comprising:

a reflector;

a power meter coupled to the reflector, wherein the power meter and reflector are tuned to receive first circularly polarized signals;

an alignment mechanism, coupled to the reflector, wherein the alignment mechanism is manipulated to point the reflector at an orbital slot wherein only one satellite in the orbital slot transmits the first circularly polarized signals, to adjust the reflector to maximize reception of the first circularly polarized signals from the orbital slot, and to offset the reflector from a position where maximum reception of the first circularly polarized signal is measured.

5. The system of claim 4, wherein at least one other satellite in the orbital slot transmits second circularly polarized signals.

6. The system of claim 4, wherein the satellite in the orbital slot transmits in a Ka-band of frequencies.

7. A system for receiving satellite signals, the satellite signals being transmitted from a plurality of orbital slots, comprising:

a reflector; and an alignment mechanism, coupled to the reflector, wherein the alignment mechanism is manipulated to point the reflector at an alignment point of maximum signal strength in a selected orbital slot in the plurality of orbital slots, wherein only one satellite in the selected orbital slot transmits the first circularly polarized signals, and wherein the reflector is offset from the alignment point.

8. The system of claim 7, wherein at least one other satellite in the selected orbital slot transmits second circularly polarized signals.

9. The system of claim 7, wherein the satellite in the orbital slot transmits in a Ka-band of frequencies.

10. The system of claim 7, wherein the alignment point is determined by a signal strength of the first circularly polarized signals.

11. The system of claim 10, wherein the reflector is offset from the alignment point based on a total number of satellites located at the selected orbital slot.

* * * * *